US007386986B2

(12) United States Patent
Kim

(10) Patent No.: US 7,386,986 B2
(45) Date of Patent: Jun. 17, 2008

(54) APPARATUS FOR GENERATING HEAT OF REFRIGERATOR AND CONTROL METHOD THEREOF

(75) Inventor: Jin-Sung Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 399 days.

(21) Appl. No.: 10/975,436

(22) Filed: Oct. 29, 2004

(65) Prior Publication Data

US 2005/0091995 A1 May 5, 2005

(30) Foreign Application Priority Data

Nov. 4, 2003 (KR) ..... 10-2003-0077619

(51) Int. Cl.
*F25D 11/02* (2006.01)

(52) U.S. Cl. ..... 62/126; 62/129

(58) Field of Classification Search ..... 62/126, 62/131, 228.1, 129, 263–264; 165/263–264
See application file for complete search history.

(56) References Cited

U.S. PATENT DOCUMENTS 2,724,576 A * 11/1955 Jacobs ..... 165/263
2,724,577 A * 11/1955 Murphy ..... 165/263
2,780,441 A * 2/1957 Rhodes ..... 165/233
6,216,480 B1 * 4/2001 Camus et al. ..... 62/235.1
6,355,885 B1 * 3/2002 Rintz et al. ..... 174/66
6,784,784 B1 * 8/2004 Zehrung ..... 340/5.3
2003/0145617 A1 * 8/2003 Jung ..... 62/230

FOREIGN PATENT DOCUMENTS

WO WO 0075585 A1 * 12/2000

* cited by examiner

*Primary Examiner*—Melvin Jones
(74) *Attorney, Agent, or Firm*—Ked & Associates, LLP

(57) ABSTRACT

An apparatus for generating heat and a control method thereof are provided which are capable of reducing the cost and simplifying coupling by using a cheap diode for lowering an applied voltage of a lamp instead of using an expensive capacitor used for the apparatus for generating heat for low temperature compensation. The apparatus includes a door opening/closing sensor for sensing whether a refrigerator door is opened or closed; a temperature sensor for sensing a temperature of outside air; a control unit for outputting a control signal for driving a lamp upon receiving a signal of the door opening/closing sensor and outputting a control signal for low temperature compensation upon receiving a signal of the temperature sensor; a switch controlled to be turned on by the control signal for driving the lamp; a relay controlled to be turned on by the control signal for low temperature compensation; a lamp connected in series with the switch and the relay and performing lighting and heat generation operations; and a diode connected in series with the relay and half-wave rectifying the power applied to the lamp.

5 Claims, 3 Drawing Sheets

APPARATUS FOR GENERATING HEAT OF REFRIGERATOR AND CONTROL METHOD THEREOF

BACKGROUND OF THE INVENTION

1. Field of the Invention

The present invention relates to a refrigerator, and more particularly, to an apparatus for generating heat of a refrigerator and a control method thereof capable of reducing the cost and simplifying a structure by using a lamp and a diode for lowering an applied voltage.

2. Description of the Background Art

In general, a refrigerator is divided into a freezing chamber for storing frozen food and a chilling chamber for storing chilled food, and a freezing cycle is provided therein to supply cool air to the freezing chamber and the chilling chamber.

Such a refrigerator is classified into a direct cooling type refrigerator employing a way of natural convection in which a cooling operation is performed by making air inside the refrigerator directly contact with an evaporator and an indirect cooling type refrigerator in which the cooling operation is performed by forming a duct, which cool air circulates through, inside the refrigerator and forcibly sending the cool air to the inside of the refrigerator by a blast fan.

The direct cooling type refrigerator is typically used for a small refrigerator having a small volume and the indirect cooling type refrigerator is typically used for a large refrigerator having a large volume.

FIG. 1 is a view showing a freezing cycle of the conventional direct cooling type refrigerator. As shown therein, a main body 15 of a refrigerator 11 is divided into an upper freezing chamber 4 and a lower chilling chamber 7, in which a freezing chamber evaporator 5 and a chilling chamber evaporator 6 are installed, respectively. In addition, a condenser 2 and a radiator 3 are installed at a rear surface of the exterior of the refrigerator 11, and a chamber having a compressor 1 or the like is disposed at a rear surface of a lower portion of the refrigerator.

Both the freezing chamber evaporator 5 installed in the freezing chamber 4 and the chilling chamber evaporator 6 installed in the chilling chamber 7 are direct cooling plate-shaped evaporators. The freezing chamber evaporator 5 has an area covering the surfaces, i. e. upper and lower surfaces and both side surfaces, other than a rear surface of the freezing chamber 4 and a door. Namely, the freezing chamber evaporator 5 is bent in a lattice type to cover the upper and lower surfaces and the both side surfaces of the freezing chamber. The chilling chamber evaporator 6 has a small area compared to the freezing chamber evaporator 5 and is attached to a rear surface of the chilling chamber 7.

Heat from a high temperature high pressure refrigerant discharged from the compressor 1 radiates passing through the condenser 2 and pressure of the refrigerant is reduced passing through a capillary tube 3, whereby the high temperature high pressure refrigerant becomes a low temperature low pressure refrigerant.

The low temperature low pressure refrigerant firstly absorbs heat passing through the evaporator of the freezing chamber 4, absorbs heat again passing through the chilling chamber evaporator 6, and is sucked into the compressor 1.

In the direct cooling type refrigerator, a surface temperature of an inner wall at which the evaporator 6 for chilling of the chilling chamber 7 is mounted is sensed, and according to the sensed temperature, an operation of the compressor 1 is controlled.

Namely, the direct cooling type refrigerator is designed to remain at a temperature of −18° C. and 3° C. for the freezing chamber 4 and the chilling chamber 7, respectively. According to the temperature sensed at the inner wall of the chilling chamber 7, driving of the compressor 1 is on/off, so that the temperature of the freezing chamber 4 and the chilling chamber 7 remains at a set temperature.

However,when outside air is below 10° C., an external load of the chilling chamber 7 is significantly reduced in comparison to that of the freezing chamber 4. Therefore, there is a problem that the compressor 1 is turned off before a temperature inside the freezing chamber 4 reaches −18° C. Namely, because there are not many external loads of the chilling chamber 7, a temperature inside the chilling chamber 7 easily reaches 3° C., which causes the compressor 1 not to operate before the temperature of the chilling chamber 7 reaches a target temperature.

Accordingly, in the conventional direct cooling refrigerator, a temperature which a temperature sensor senses is raised using a lamp 10 mounted in the chilling chamber 7 in case that weak cooling occurs before the temperature of the freezing chamber 4 reaches the target temperature because a temperature around the refrigerator is relatively low.

The lamp 10 is used for lighting when a door of the chilling chamber 7 is opened. It also functions as low temperature compensation for raising a temperature which the temperature sensor senses.

FIG. 2 is a schematic diagram showing a construction of a lamp heat generating apparatus of the conventional refrigerator. As shown therein, if the lamp 10 mounted at the chilling chamber 7 consumes the rectified power, the temperature inside the chilling chamber 7 is considerably raised to have a bad effect on controlling a temperature of the refrigerator 11. Accordingly, when the door of the refrigerator is closed, a switch 40 is turned off and a relay 30 is turned on such that a voltage is applied to both a lamp 10 and a capacitor 50. Therefore, the lamp 10 consumes the power lower than the rectification input to raise the temperature sensed by the temperature sensor of the refrigerator 11.

However, since the capacitor 50 which is used to lower the lamp 10 is expensive, economical efficiency is lowered. In addition, since the capacitor is comparatively bulky, a coupling structure is large and complicated.

SUMMARY OF THE INVENTION

Therefore, an object of the present invention is to provide an apparatus for generating heat and a control method thereof capable of reducing the cost and simplifying coupling by using a cheap diode for lowering an applied voltage of a lamp instead of using an expensive capacitor used for the apparatus for generating heat for low temperature compensation.

To achieve these and other advantages and in accordance with the purpose of the present invention, as embodied and broadly described herein, there is provided an apparatus for generating heat of a refrigerator, comprising: a door opening/closing sensor for sensing whether a refrigerator door is opened or closed; a temperature sensor for sensing a temperature of outside air; a control unit for outputting a control signal for driving a lamp upon receiving a signal of the door opening/closing sensor and outputting a control signal for low temperature compensation upon receiving a signal of the temperature sensor; a switch controlled to be turned on by the control signal for driving the lamp; a relay controlled to be turned on by the control signal for low temperature compensation; a lamp connected in series with the switch and the relay and performing lighting and heat generation operations; and a diode connected in series with the relay and half-wave rectifying the power applied to the lamp.

To achieve these and other advantages and in accordance with the purpose of the present invention, as embodied and broadly described herein, there is provided a control method of the apparatus for generating heat of the refrigerator, comprising: a first step of measuring a temperature of outside air and comparing the measured temperature with a set temperature; a second step of determining whether a door is opened or closed; and a third step of turning on/off a relay, a diode and a switch connected in series with a lamp for heat generation and lighting according to the results of the first and second steps.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings. There can be a plurality of embodiments in accordance with the present invention, and, hereinafter, the most preferable embodiment will be described.

Figure 1:
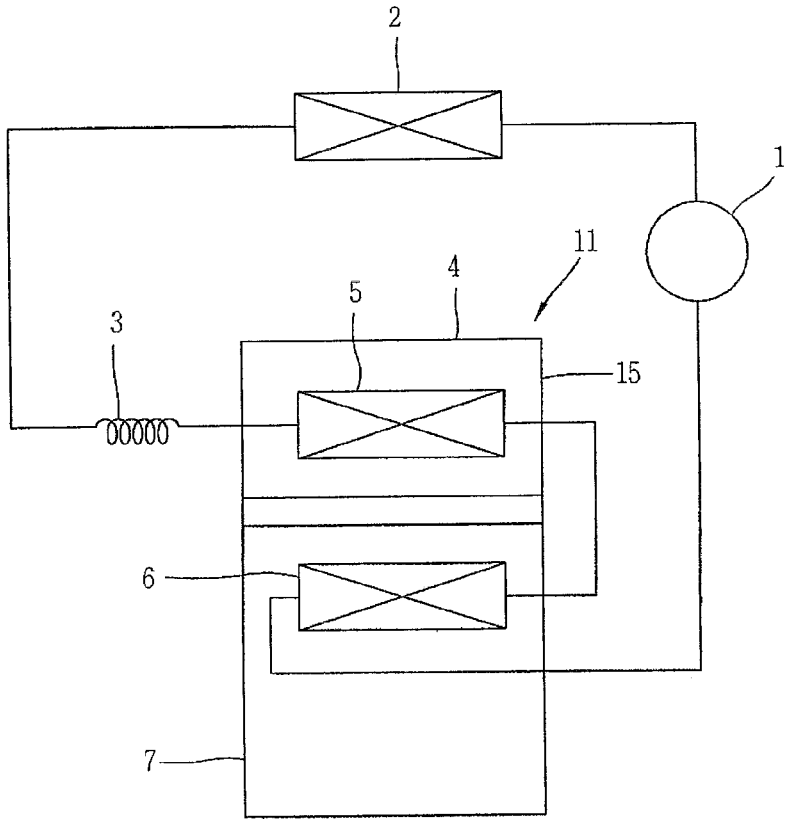
FIG. 1 is a view showing a freezing cycle of the conventional direct cooling type refrigerator.
Figure 2:
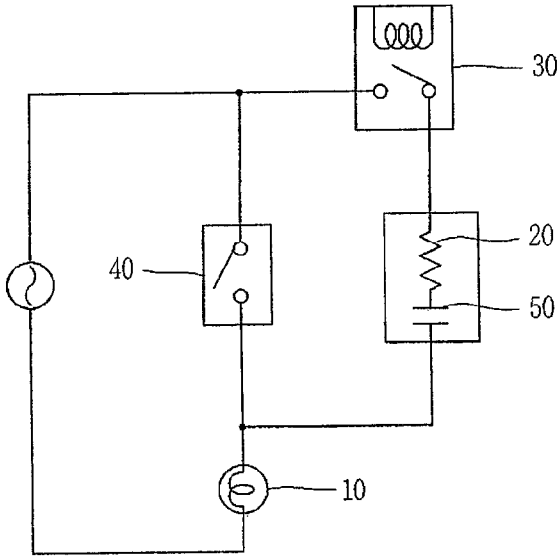
FIG. 2 is a schematic diagram showing a construction of a lamp heat generating apparatus of the conventional refrigerator.
Figure 3:
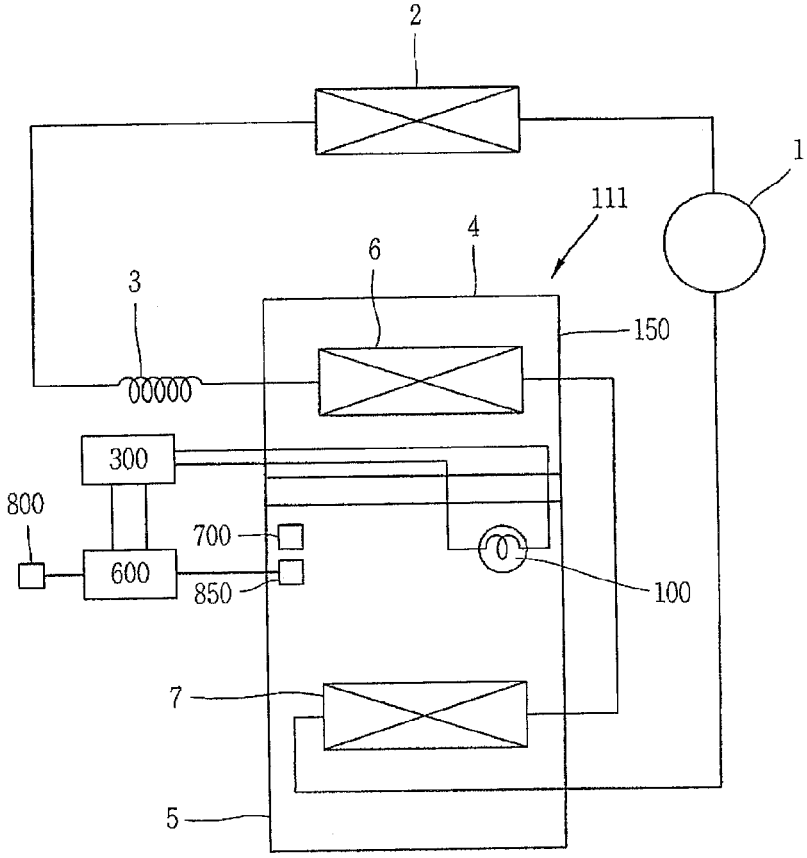
FIG. 3 is a construction view illustrating a direct cooling type refrigerator in accordance with the present invention.

FIG. 3 is a construction view illustrating a direct cooling type refrigerator in accordance with the present invention. As shown therein, a main body 150 of a refrigerator 111 is divided into an upper freezing chamber 4 and a lower chilling chamber 5, in which a freezing chamber evaporator 6 and a chilling chamber evaporator 7 are installed. In addition, a condenser 2 and; a radiator 3 are installed at a rear surface of the exterior of the refrigerator 111 and a chamber having a compressor 1 or the like is disposed at a rear surface of a lower portion of the refrigerator 111.

Heat from a high temperature high pressure refrigerant discharged from the compressor 1 radiates passing through the condenser 2 and pressure of the refrigerant is reduced passing through a capillary tube 3, whereby the high temperature high pressure refrigerant becomes a low temperature low pressure refrigerant. The low temperature low pressure refrigerant firstly absorbs heat passing through the freezing chamber evaporators 6, absorbs heat again passing through the chilling chamber evaporator 7, and is sucked into the compressor 1. These processes are the same as those of the conventional art.

A door (not shown) which can be opened or closed and is installed at the main body 150 of the refrigerator 111 is mounted at one side of the refrigerator 111. The refrigerator door can be a one-door type that the chilling chamber 5 and the freezing chamber 4 are opened or closed at a time and a two-door type that the chilling chamber 5 and the freezing chamber 4 have doors, respectively.

A door opening/closing sensor 700 for sensing whether the door is opened or closed is positioned adjacent to the door and inside the refrigerator 111. Also, in the refrigerator 111, a surface temperature of an inner wall on which the chilling chamber evaporator 7 for sensed by a temperature sensor 850, and according to the sensed temperature, an operation of the compressor 1 is controlled.

The lamp 100 installed in the refrigerator 111 is used for lighting when a door is opened. Moreover, it also functions as heat generation for raising a temperature which the temperature sensor 850 senses. The lamp 100 is connected to a control unit 600 through circuit elements to be described later.

Figure 4:
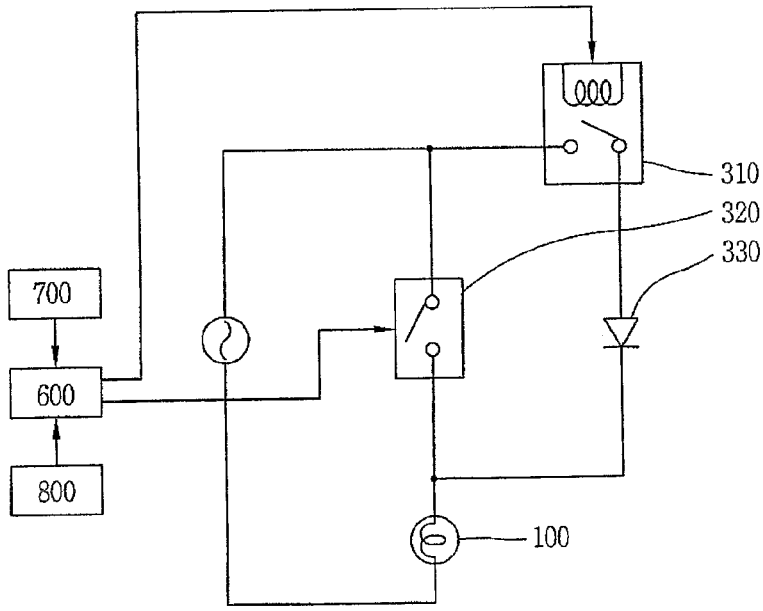
FIG. 4 is a schematic view showing a construction of an apparatus for generating heat of the refrigerator in accordance with the present invention.

FIG. 4 is a schematic view showing a construction of an apparatus for generating heat of the refrigerator in accordance with the present invention. As shown therein, the apparatus for generating heat of the refrigerator includes: a door opening/closing sensor 700 for sensing whether a refrigerator door is opened or closed; a temperature sensor 800 for sensing a temperature of outside air; a control unit 600 for outputting a control signal for driving a lamp 100 upon receiving a signal of the door opening/closing sensor and outputting a control signal for low temperature compensation upon receiving a signal of the temperature sensor 800; a switch 320 controlled to be turned on by the control signal for driving the lamp 100; a relay 310 controlled to be turned on by the control signal for low temperature compensation; the lamp 100 connected in series with the switch 320 and the relay 310 and performing lighting and heat generation operations; and a diode 330 connected in series with the relay 310 and half-wave rectifying the power applied to the lamp 100.

The door opening/closing sensor 700 may have a construction that a switch is mechanically short-circuited according to movements of the door or that a state that the door is opened or closed can be seized by determining whether an infrared signal is transmitted or received using infrared rays or the like.

Preferably the temperature sensor 800 is not installed near the compressor or the condenser of which temperatures are higher than the temperature of the outside air. Namely, in order to measure the exact temperature of the outside air, the temperature sensor 800 should be installed in order that operation heat of the compressor 1 or the condenser 2 cannot interfere with the temperature sensor 800.

A general microprocessor is used as the control unit.

The relay 310 can be replaced with a general switch.

As described above, the lamp 100 functions not only as the lighting when opening the door but also as heat generation to raise the temperature which the temperature sensor 850 installed at the chilling chamber senses.

The diode 330 refers to two-terminal solid-state devices having rectification. The rectification means characteristics that the forward direction in which a current flows smoothly and the reverse direction in which few current flows are discriminated according to the direction of voltages applied to the two terminals.

Hereinafter, an operation of the apparatus for generating heat of the refrigerator in accordance with the present invention will be described as follows.

The temperature sensor 800 senses a temperature around the refrigerator 111 and applies the sensed temperature to the control unit 600. The door opening/closing sensor 700 senses whether the door is opened or closed, and applies the sensed result to the control unit 600.

According this, when it is sensed that the door is opened, the control unit 600 applies the control signal for driving the lamp 100 to the switch 320 to turn on the switch 320. The control unit 600 applies power to the lamp 100 through the switch 320 to turn on the lamp 100.

Meanwhile, when it is not sensed that the door is opened, if the temperature of the outside air inputted to the temperature sensor 800 is lower than a standard temperature, the control unit 600 applies the control signal for low temperature compensation to the relay 310 and the control signal for driving the lamp 100 to the switch 320.

Accordingly, the switch 320 is turned off and the relay 310 is turned on to apply the power to the lamp 100 through the diode 330. At this time, the power is half-wave rectified through the diode 330 and applied to the lamp 100. Namely, despite the fact that it is not necessary to use the lamp 100 for lighting when the door is closed, the temperature inside the refrigerator 111 is considerably raised if the lamp 100 consumes the rectified power, which leads to have a bad effect on controlling a temperature of the refrigerator 111. Therefore, the half-wave power is applied to the lamp 100 through the diode 330.

Hereinafter, a control method of the apparatus for generating heat of the refrigerator will be described as follows.

Figure 5:
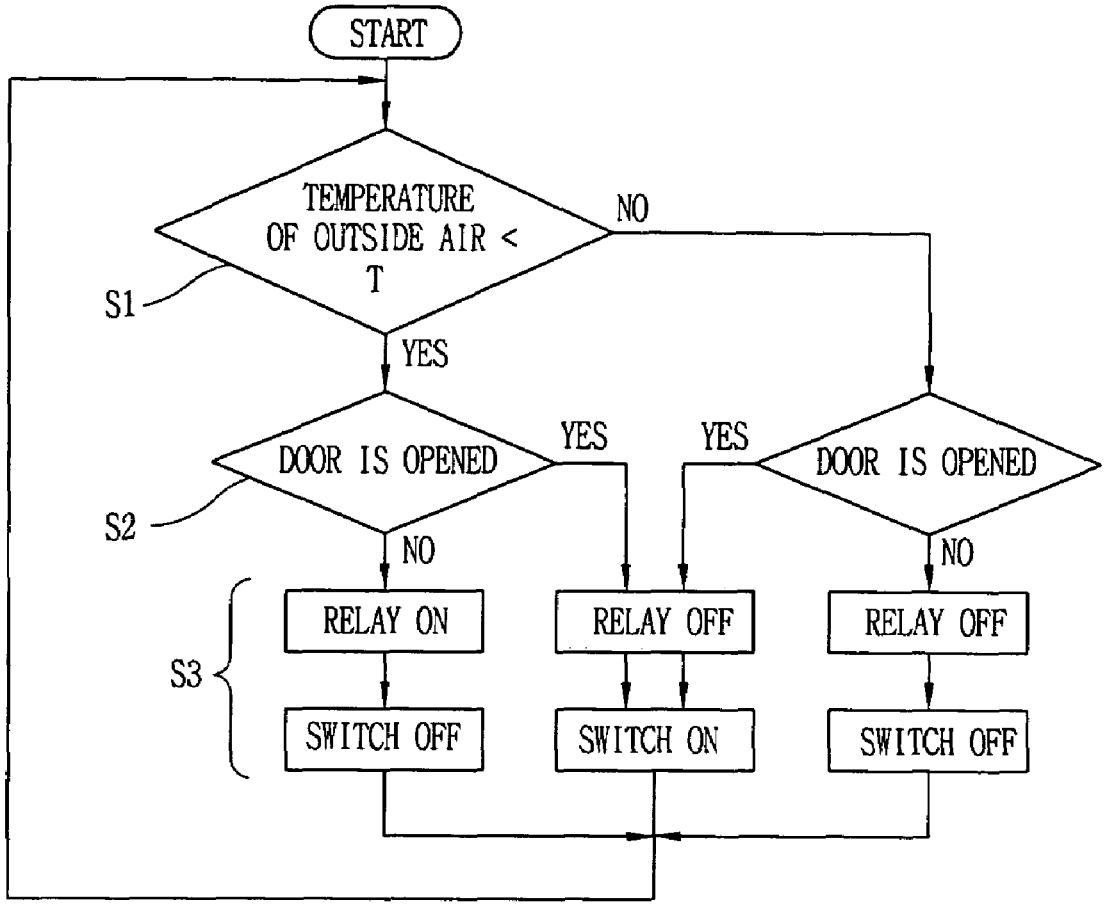
FIG. 5 is a flowchart illustrating a control method of the apparatus for generating heat of the refrigerator in accordance with the present invention.

FIG. 5 is a flowchart illustrating a control method of the apparatus for generating heat of the refrigerator in accordance with the present invention.

As shown therein, a control method of the apparatus for generating heat of the refrigerator in accordance with the present invention includes: a first step S1 of measuring a temperature of outside air and comparing the measured temperature with a set temperature; a second step S2 of determining whether a door is opened or closed; and a third step S3 of turning on/off a relay, a diode and a switch connected in series with a lamp for heat generation and lighting according to the results of the first and second steps.

In the first step S1, the temperature of the outside air read from the temperature sensor is compared to the set temperature, for example, through an OP AMP or the like. Since it can be determined that low temperature compensation is required when the temperature of the outside air is lower than the set temperature, it is necessary to use the lamp for lighting.

The set temperature is preferably 10° C.

In the second step S2, it is determined whether the door is opened or closed. According to the results of the first and second steps, the control signal for driving the lamp and the control signal for low temperature compensation are applied to each component. When the door is opened, lighting is necessary to draw food out. Therefore, it is determined that the lamp needs to be used for lighting.

In the third step S3, each component is driven upon receiving the control signal. When it is determined that the temperature of the outside air is lower than the set temperature in the first step S1 and when it is determined that the door is opened in the second step S2, the relay is turned off and the switch is turned on such that the lamp consumes the power to emit light.

When it is determined that the temperature of the outside air is lower than the set temperature in the first step S1 and when it is determined that the door is closed in the second step S2, the relay is turned on to operate the lamp through the diode and the switch is turned off.

When it is determined that the temperature of the outside air is higher than or equal to the set temperature in the first step S1 and when it is determined that the door is opened in the second step S2, the relay is turned off and the switch is turned on such that the lamp consumes the power to emit light.

When it is determined that the temperature of the outside air is higher than or equal to the set temperature in the first step S1 and when it is determined that the door is closed in the second step S2, the relay is turned off and the switch is turned off such that the lamp does not operate. Namely, since there is no need for light or heat generation, the lamp does not work by breaking a circuit connected to the lamp.

The present invention having such construction can reduce the cost by using the cheap diode for half-wave rectifying the voltage of the lamp and applying the half-wave power instead of using the expensive capacitor for reducing the amount of heat generation of the lamp for low temperature compensation.

In addition, the structure can be further simplified and the coupling structure can be improved by replacing the comparatively bulky capacitor with the diode.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A control method of an apparatus for generating heat in a refrigerator, comprising:

a first step of measuring a temperature of outside air and comparing the measured temperature with a set temperature;

a second step of determining whether a door of the refrigerator is opened or closed; and a third step of turning on or off a relay, a diode, and a switch connected in series with a lamp for heat generation and lighting according to the results of the first and second steps, wherein the set temperature in the first step is 10° C.

2. The control method of claim 1, wherein the third step comprises:

turning the relay off and turning the switch on to operate the lamp when it is determined that the temperature of the outside air is lower than the set temperature in the first step and when it is determined that the refrigerator door is opened in the second step.

3. The control method of claim 1, wherein the third step comprises:

turning the relay on and the switch off to operate the lamp through the diode when it is determined that the temperature of the outside air is lower than the set temperature in the first step and when it is determined that the refrigerator door is closed in the second step.

4. The control method of claim 1, wherein the third step comprises:

turning the relay off and the switch on to operate the lamp when it is determined that the temperature of the outside air is higher than or equal to the set temperature in the first step and when it is determined that the refrigerator door is opened in the second step.

5. The control method of claim 1, wherein the third step comprises:

turning the relay off and the switch off when it is determined that the temperature of the outside air is higher than or equal to the set temperature in the first step and when it is determined that the refrigerator door is closed in the second step.

* * * * *